US005680724A

United States Patent [19]

Peterken

[11] Patent Number: 5,680,724

[45] Date of Patent: Oct. 28, 1997

[54] FIREARM SAFETY AND DRY-FIRE DEVICE

[76] Inventor: William H. Peterken, P.O. Box 829, 163 Hidden Lake, Higganum, Conn. 06411

[21] Appl. No.: 757,808

[22] Filed: Nov. 27, 1996

[51] Int. Cl.[6] ..... F41A 17/44

[52] U.S. Cl. ..... 42/70.11

[58] Field of Search ..... 42/70.11, 70.08

[56] References Cited

U.S. PATENT DOCUMENTS

| | | | |
|---|---|---|---|
| 3,193,959 | 7/1965 | Jaycox | 42/70.11 |
| 4,776,123 | 10/1988 | Ascroft | 42/70.11 |
| 5,070,635 | 12/1991 | Cvetanovich | 42/70.11 |
| 5,315,778 | 5/1994 | Wolford | 42/70.11 |

FOREIGN PATENT DOCUMENTS

| | | | |
|---|---|---|---|
| 2215822 | 9/1989 | United Kingdom | 42/70.11 |

*Primary Examiner*—Michael J. Carone
*Assistant Examiner*—Matthew J. Lattig
*Attorney, Agent, or Firm*—Fattibene and Fattibene; Paul A. Fattibene; Arthur T. Fattibene

[57] ABSTRACT

A cylindrical insert having a recess in one end and a notch disposed between either end of the cylindrical insert. The cylindrical insert is placed within a bolt carrier of a rifle or firearm. The recess is positioned to receiving the firing pin, preventing the cylindrical insert from contacting it. The notch is sized and positioned to receive the hammer, preventing it from impacting the firing pin when the trigger is pulled releasing the hammer. The insert, being placed within the bolt carrier, is not readily visible and effectively disables the rifle from being fired. This prevents the possibility of any accidental discharge or unauthorized use. A locking device may be attached to the insert preventing its unauthorized removal. The present invention is applicable to many different rifles or firearms and may also be used to safely dry-fire a firearm without damaging the firing pin, and requiring only limited movement of the bolt carrier to reset the hammer for dry-firing.

20 Claims, 5 Drawing Sheets

FIREARM SAFETY AND DRY-FIRE DEVICE

FIELD OF THE INVENTION

The present invention relates in general to an accessory to a rifle, and particularly to a safety device and dry-firing device for insertion into a rifle.

BACKGROUND OF THE INVENTION

There are many firearms that are in wide use, such as an AR15 or M 16 and many other similar type rifles or firearms. As with any firearm, these rifles are potentially dangerous and should be stored in a safe condition. There are many safes or lock constructions in which a rifle may be locked. Additionally, there are many locks that may attach to the trigger, preventing the rifle from operating. However, these locks are relatively bulky. They may not be desirable because they are clearly visible and may detract from any display of the firearm, and being visible it is obvious that removal will enable firing the firearm. Additionally, it may be possible that some of these locking devices may malfunction, resulting in an unintentional discharge of a cartridge in the rifle or firearm. Additionally, in many instances, it is desirable to practice by dry-firing a firearm or rifle without a cartridge in the chamber. In dry-firing the rifle, there is a risk that a cartridge may unintentionally be left in the chamber, resulting in its unintentional discharge which is potentially very dangerous. Additionally, often the firing pin is damaged if dry-firing is done repeatedly. Therefore, there is a need for a device that can safely and effectively disable the rifle or firearm with little risk of discharge.

SUMMARY OF THE INVENTION

The present invention is an insert that fits into the bolt carrier of a rifle such as an AR-15 or M 16 or other similar rifle or firearm, preventing the hammer from striking the firing pin. A cylindrical insert having a recess at either end and a notch positioned between either end is inserted into the bolt carrier of a rifle. The recess at either end of the cylindrical insert is sized and positioned so as to prevent contact of the cylindrical insert with the firing pin. The notch disposed between either end of the cylindrical insert is positioned so as to receive the hammer of the firearm, preventing its contact with the firing pin. A locking device or means may be provided to prevent unauthorized removal of the cylindrical insert.

Accordingly, it is an object of the present invention to temporarily disable a firearm.

It is another object of the present invention to permit dry-firing of a rifle without damaging the firing pin.

It is an advantage of the present invention that it is not readily visible from the exterior of the firearm.

It is an advantage of the present invention that it is easy to insert and remove.

It is another advantage of the present invention that the hammer travels a short distance, impacting the surface of the cylindrical insert with less force than if the hammer were to impact the firing pin with full force after completing its normal swing, thus cause less disturbance to the firearm and permitting the user to view a less disturbed sight picture after the trigger is pulled during dry-firing.

It is an advantage of the present invention that it requires only a very limited movement of the bolt carrier to reset the hammer for dry-firing, thus permitting the user to not be required to alter his shooting position or stance.

It is a feature of the present invention that the end of the cylindrical insert or cylinder has a recess.

It is another feature of the present invention that a notch is positioned between either end of the cylindrical insert.

These and other objects, advantages and features will become readily apparent in view of the following detailed description.

DETAILED DESCRIPTION OF THE PREFERRED EMBODIMENTS

Figure 1:
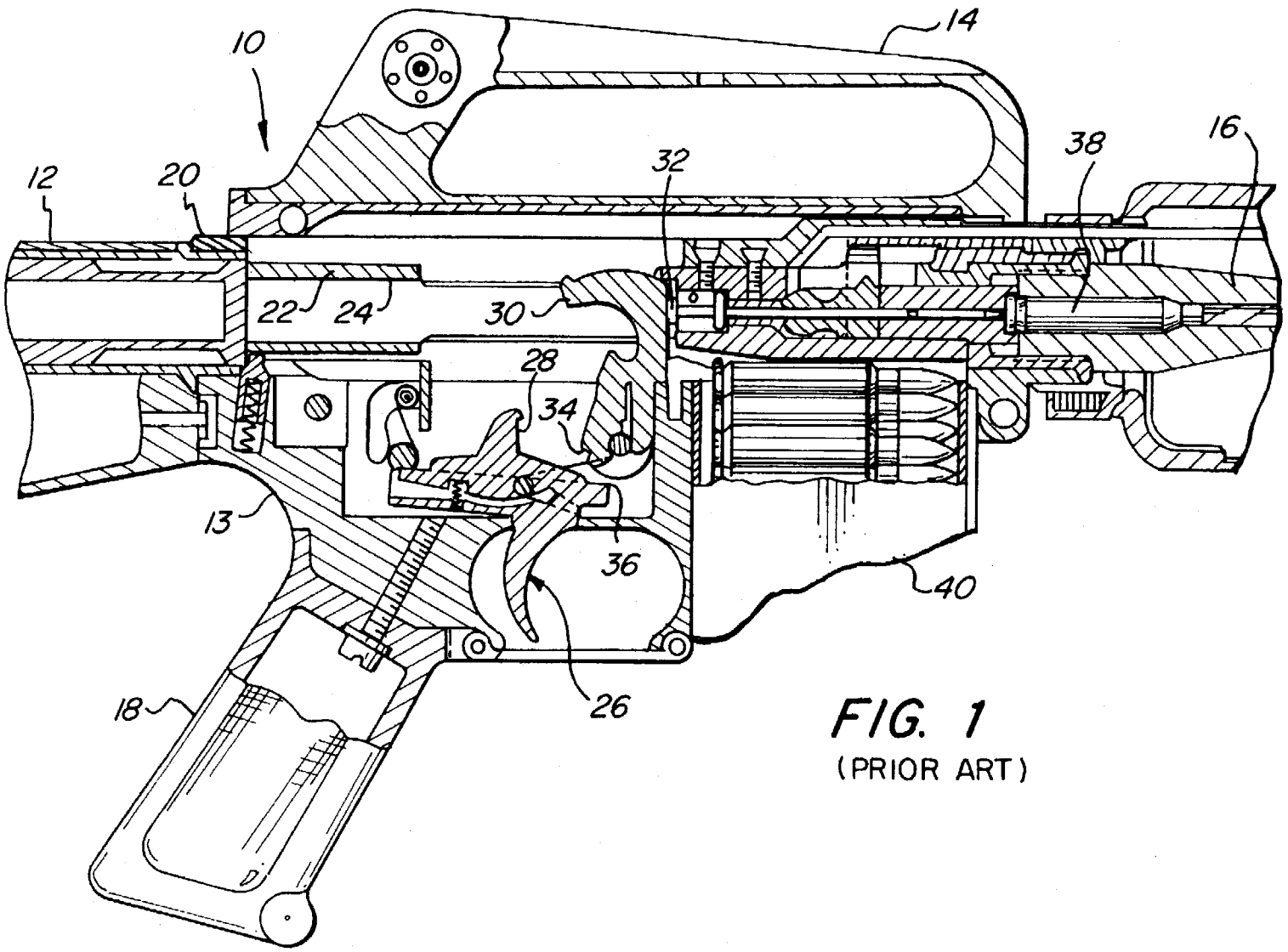
FIG. 1 (PRIOR ART)
FIG. 1 is a partial cross section illustrating a rifle of a type that can utilize the present invention.

FIG. 1 illustrates a prior art rifle 10 such as an M 16. A buttstock 12 is attached to an upper receiver 20 and a barrel 16. A grip 18 is attached to a lower receiver 13. A handle 14 is attached to, a part of, the upper receiver 20. The bolt carrier 22 has a bore 24. The bolt carrier 22 is placed within the upper receiver 20 so as to slide back and forth or reciprocate. The hammer 30 is cocked such that a notch 34 thereon hooks or mates to an edge 36 on a portion of a trigger 26 attached to a disconnector 28. When the hammer 30 is released from the edge 36, the hammer swings upward striking the firing pin 32. The hammer 30 is illustrated in its upward position in contact with the firing pin 32. The firing pin 32 is caused to strike the primer of the cartridge 38 within the barrel 16. A magazine 40 is often used to store additional cartridges. FIG. 1 generally illustrates the mechanics or operation of an M 16 rifle. Only a portion of the M 16 rifle has been generally illustrated.

Figure 2A:
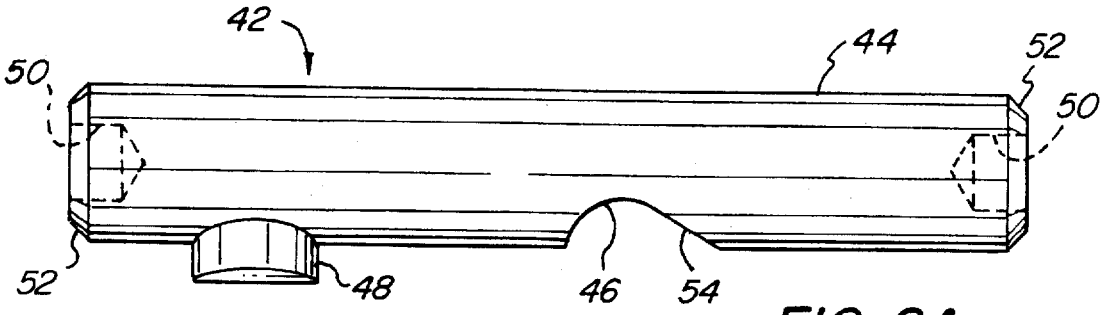
FIG. 2A is a side elevational view of one embodiment of the present invention.

FIG. 2A illustrates the present invention or insert 42. Insert 42 is intended to be placed within the bolt carrier of a rifle such as that illustrated in FIG. 1. Insert 42 is comprised of a cylindrical insert 44 having a notch 46 positioned between either end of the cylindrical insert 44. In this embodiment of the present invention, a stud 48 is placed on the same surface or side as the notch 46. At either end of the cylindrical insert 44 are recesses 50. Each end of the cylindrical insert 44 also has a bevel 52. The bevel at the end adjacent the notch 46 may be tapered more than the end adjacent the stud 48 if the rifle used with the insert 42 has a taper or step in the bore of the bolt carrier. One portion of notch 46 is generally circular and the other portion flatter. The flatter portion is a hammer striking surface 54. The hammer striking surface 54 is angled and relatively flat and adapted to receive the surface of a hammer.

Figure 2B:
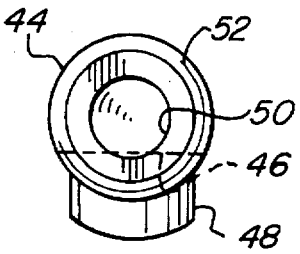
FIG. 2B is a front elevational view of the present invention illustrated in FIG. 2A.

FIG. 2B more clearly illustrates one end of the insert 42 illustrated in FIG. 2A.

Figure 3A:
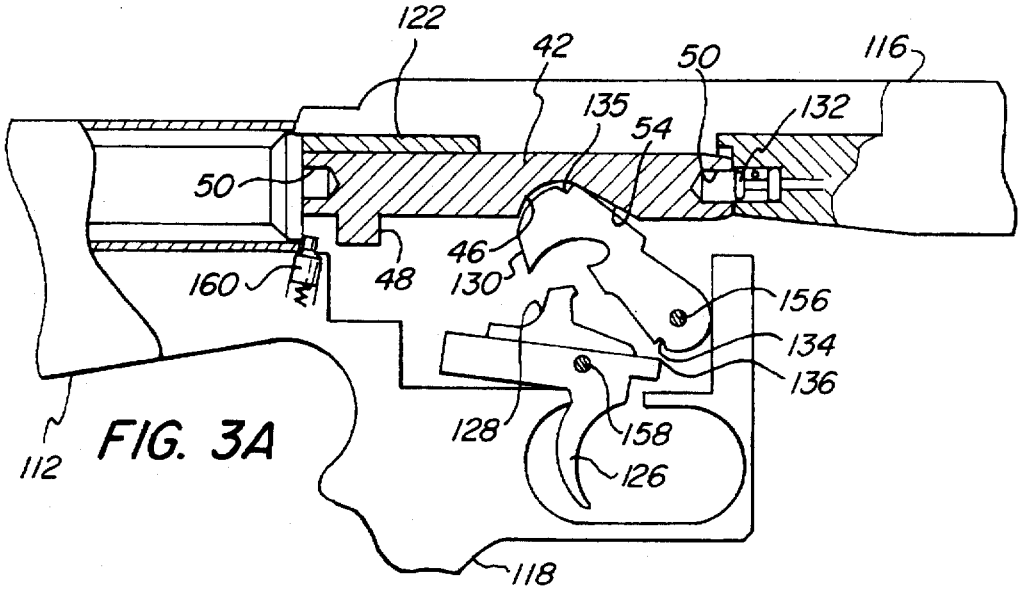
FIG. 3A schematically illustrates the present invention placed within a rifle.
Figure 3B:
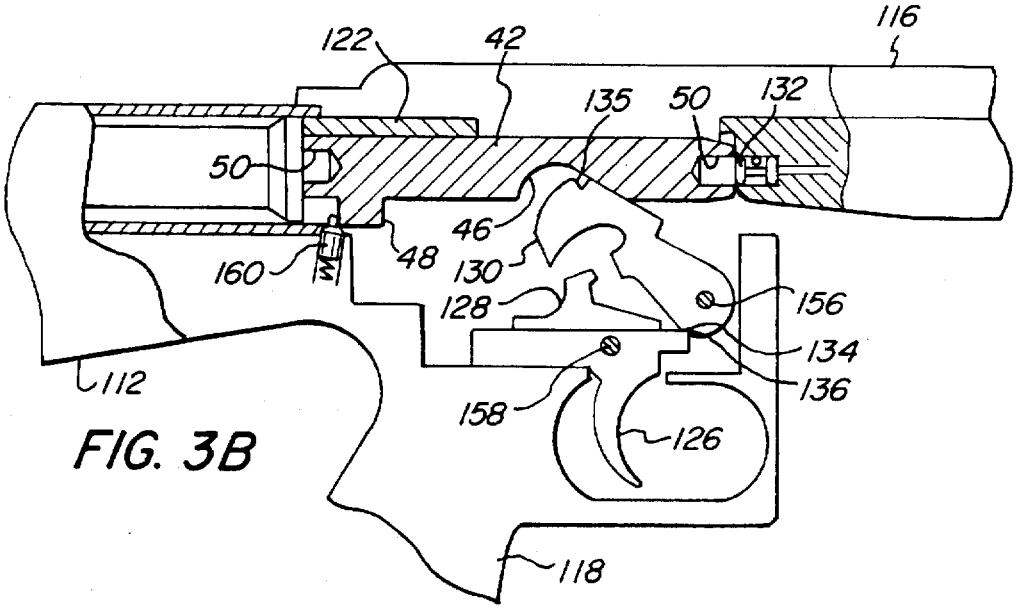
FIG. 3B schematically illustrates the present invention placed within a rifle in a slightly different position from FIG. 3A.

FIGS. 3A and 3B illustrate the embodiment shown in FIGS. 2A and 2B of the present invention in a rifle similar to that illustrated in FIG. 1. For example, a Sporter rifle or Match Target rifle manufactured by Colt Manufacturing Company, Inc. This rifle is similar to the version illustrated in FIG. 1, with the exception that the bolt carrier 122 does not extend completely around with a cutaway lower portion, and a notch 135 is formed on the top of hammer 130. Insert 42 is placed within the bolt carrier 122 such that recess 50 on one end of the insert 42 prevents the insert 42 from striking the firing pin 132. When the trigger 126 pivots on trigger pivot pin 158, the edge 136 releases the notch 134 on the hammer 130 causing it to pivot upward on hammer pivot pin 156. The hammer 130 strikes the relatively flat hammer striking surface 54 within notch 46. As a result, the hammer 130 is prevented from striking the firing pin 132. Accordingly, a cartridge cannot be discharged. FIG. 3B illustrates the movement slightly rearward of the bolt carrier 122. As the bolt carrier 122 is moved rearward, the insert 42 moves rearward with it until stud 48 is caused to strike shot pin 160. Accordingly, the rearward movement of the insert 42 is prevented from extending further. This prevents the forward end of the insert 42 from catching on notch 135 in hammer 130. However, the rearward motion is sufficient to cause hammer 130 to be reset on the edge 136 on the trigger 126, permitting the rifle to be dry-fired after the bolt carrier 22 is allowed to return into battery, its fully forward position, under spring pressure. The rifle illustrated in FIGS. 3A and B is similar to the rifle illustrated in FIG. 1, in that it also has a buttstock 112, a front portion of the action 116, and a grip 118.

Figure 4A:
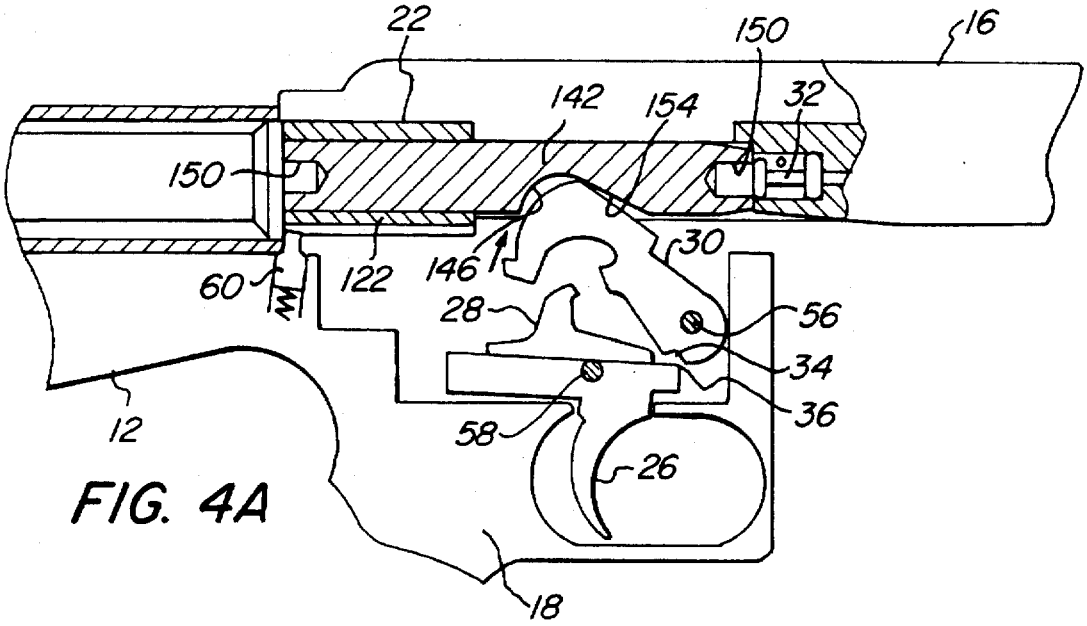
FIG. 4A schematically illustrates another embodiment of the present invention within a rifle.
Figure 4B:
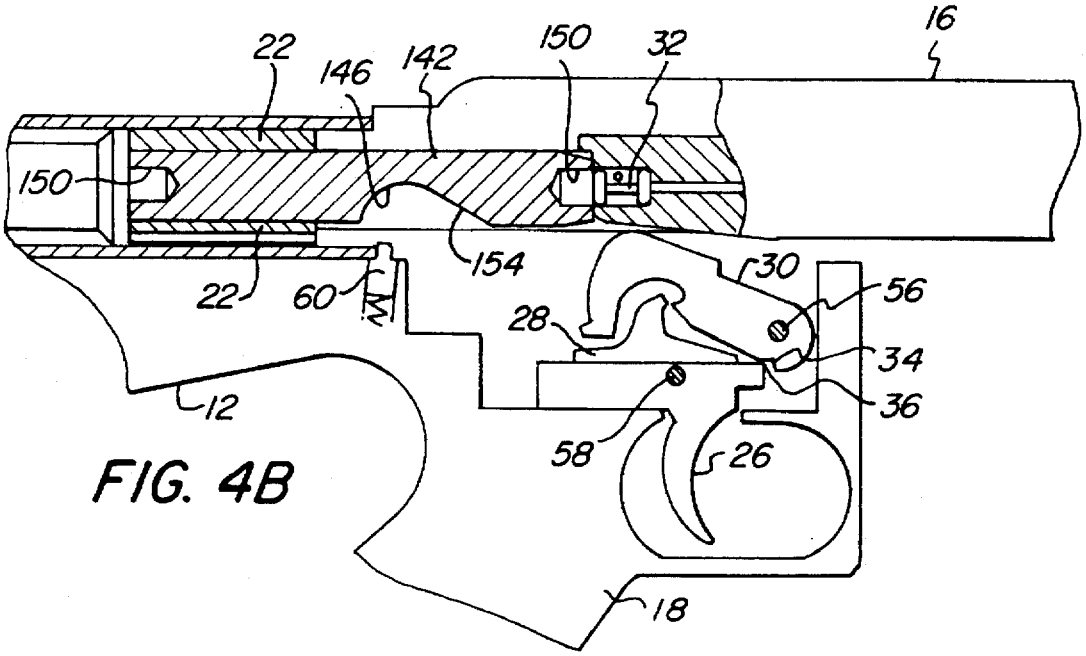
FIG. 4B schematically illustrates the embodiment of the present invention as illustrated in FIG. 4A in a slightly different position.

FIGS. 4A and 4B illustrate another embodiment of the present invention for use with a firearm such as that illustrated in FIG. 1. The firearm illustrated in FIGS. 4A and B is slightly different than that illustrated in FIGS. 3A and B in that the bolt carrier is not cut away on the lower portion and does not extend completely around the insert 142. Additionally, the hammer 30 does not have a notch therein, as did the hammer 130 illustrated in FIGS. 3A and 3B. The insert illustrated in FIGS. 4A and B has a notch 146 positioned between either end of insert 142 for receiving the hammer 130. Recesses 150 are also placed at either end of insert 142. The recesses 150 are positioned in size to receive the firing pin 32. The operation of the insert 142 illustrated in FIGS. 4A and 4B is similar to that of the insert 42 illustrated in FIGS. 3A and 3B, with the exception that the travel or reciprocating distance of the bolt carrier 22 is not limited because there is no stud impacting the shot pin 60. As illustrated in FIG. 4B, when the bolt carrier 22 is moved rearward, the insert 142 also moves rearward. In this embodiment, there is no stud to strike a shot pin 60. As the bolt carrier moves rearward, the hammer 30 pivots rearward on hammer pivot pin 56, cocking the hammer 30 and causing notch 34 to latch onto edge 36 on the trigger 26 which is permitted to pivot on trigger pivot pin 58. When the bolt carrier 22 is repositioned forward, the rifle may be dry-fired, resulting in the release of the hammer 30 causing it to strike hammer striking surface 154. The notch 146 is comprised of a circular portion and a relatively flat hammer striking surface 154.

The insert 42 illustrated in FIGS. 2A and B and the insert 142 illustrated in FIGS. 4A and 4B have recesses 50 and recesses 150 respectively in either end of the cylindrical portion so that, should inserts 42 and 142 be placed within the bolt carrier backwards or improperly, neither end will be permitted to impinge the firing pin 32 or 132. Additionally, both ends may be beveled or tapered to facilitate inserting into the bolt carrier 22. Additionally, the notch 46 or 146 may be made larger, or two notches may be placed within the insert, so that the insert can be made functional irrespective of which end is placed within the bolt carrier first.

Figure 5:
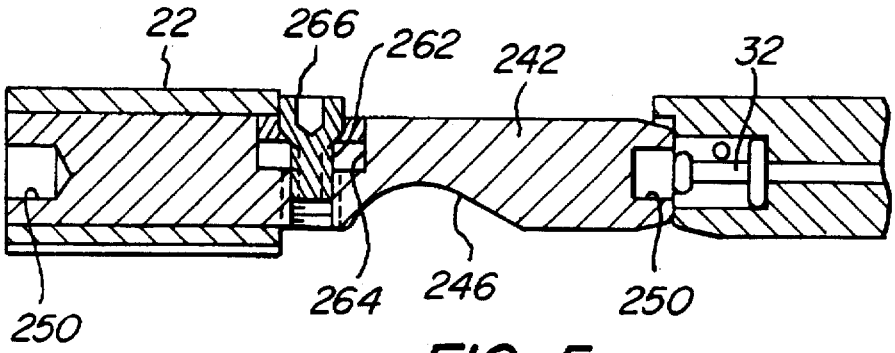
FIG. 5 is a cross section illustrating an embodiment of the present invention having a locking device.
Figure 6:
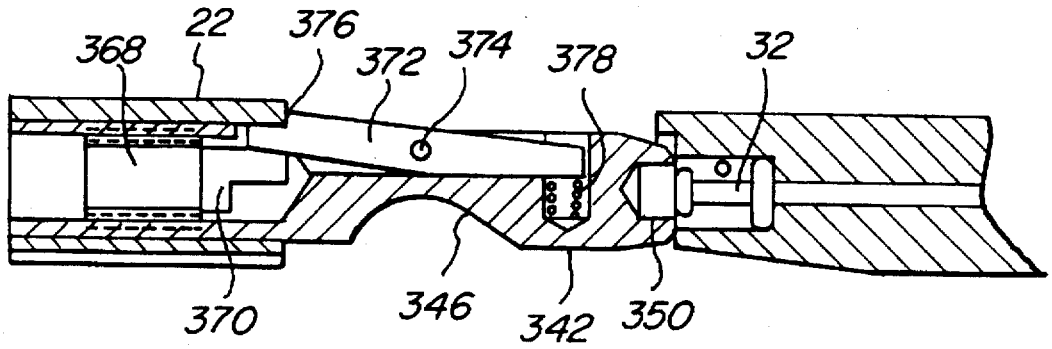
FIG. 6 is a cross section illustrating an embodiment of the present invention having another type of locking device.

FIGS. 5 and 6 illustrate additional embodiments of the present invention having a locking device or locking means. In FIG. 5, the insert 242 has a screw 262 threaded therein. A bore 264 formed within the insert 242 provides sufficient depth so that when the head of screw 262 is threaded into the insert 242, the insert 242 sufficient clearance is provided so that the insert can be removed from the bolt carrier 22. Recesses 250 are formed at either end of the insert 242, preventing the insert 242 from striking the firing pin 32. Additionally, the notch 246 prevents a hammer, not shown, from striking the firing pin 32. The screw 262 may have a proprietary head 266 for preventing unauthorized removal. The proprietary head will be something other than a slot or a hex so that standard or conventional screwdrivers and Allen wrenches cannot be used in removing the insert 242, thereby preventing unauthorized removal.

FIG. 6 illustrates another embodiment having a locking device or locking means. In this embodiment insert 342 has a locking cylindrical insert 368, which may be key-operated, which turns a cam 370. The cam 370 pushes lever 372 upward. The lever 372 pivots on pivot 374, pushing spring 378 downward. In this raised position, one end of the lever 372, having a shoulder 376 thereon, strikes an edge of the bolt carrier 22. Accordingly, in this embodiment, the insert 242 is securely locked into position within the bolt carrier 22, preventing unauthorized removal. Recess 350 prevents contact with the firing pin 32. Notch 346 prevents the hammer, not illustrated, from striking the firing pin 32. This embodiment may be modified to eliminate the lever and simplify it by extending the cam 370 slightly forward of the edge of the bolt carrier 22 and having an extended lobe or a cam surface such that when rotated, a portion of the cam extends upward so as to catch the inside edge of the bolt carrier 22, thereby preventing removal of the insert. It should be appreciated that while several locking devices or locking means have been illustrated, there are other equivalent locking devices that can be used or incorporated into the present invention.

Figure 7:
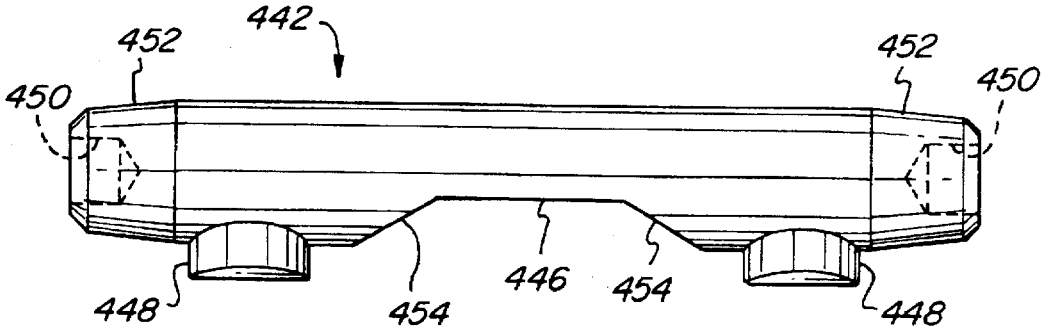
FIG. 7 is another embodiment of the present invention.

FIG. 7 illustrates another embodiment of the present invention. In this embodiment a cylindrical insert 442 may be placed within the bolt carrier 22, illustrated in FIG. 1, in either direction. The cylindrical insert 442 has a double notch 446 placed therein. The double notch 446 has a longitudinal length sufficient to permit movement of the hammer, illustrated in FIG. 1, to strike the hammer striking surfaces 454 irrespective of the end first inserted into the bolt carrier 22, illustrated in FIG. 1. Recesses 450 are placed in either end of the cylindrical insert 442 for receiving the firing pin. The ends of the cylindrical insert 442 may have a taper 452. A preferred taper 452 may be approximately 10 degrees for a longitudinal length of approximately 0.375 inches or 0.95 cm. A stud 448 is placed adjacent each end of the cylindrical insert 442. This embodiment is advantageous in that it is functional irrespective of which end is first inserted into the bolt carrier 22, illustrated in FIG. 1. While the embodiment illustrated in FIG. 7 has been illustrated with two studs 448, it should be appreciated that studs 448 may not be needed depending on the rifle.

Accordingly, from the above description, it should be appreciated that the present invention provides a safety device that is reliable, that is easy to insert and remove, and that renders the firearm or rifle inoperative. Additionally, the present invention is relatively simple and easy to manufacture with no moving parts that can fail or break. Accordingly, once inserted into the firearm or rifle, the possibility of an accidental discharge is substantially reduced, permitting safe storage and/or dry-firing of the firearm. The present invention also permits dry-firing practice without damage to the firing pin.

While various embodiments have been described, it should be appreciated to those skilled in the art that variations may be made without departing from the spirit and scope of this invention.

What is claimed is:

1. An insert for a firearm comprising:

a cylinder having a first and second end, said cylinder having a notch positioned between the first and second end to receive a hammer and a recess on one of the first and second ends of said cylinder, the recess positioned to receive a firing pin, whereby when placed in a bolt carrier of the firearm the hammer is prevented from impacting the firing pin.

2. An insert as in claim 1 further comprising:

a stud extending from said cylinder.

3. An insert as in claim 1 further comprising:

a second recess on the other end of said first and second ends of said cylinder.

4. An insert as in claim 1 wherein:

the first and second ends are beveled.

5. An insert as in claim 1 wherein:

the first and second ends are tapered.

6. An insert as in claim 1 wherein:

the notch has a circular portion and a straight portion.

7. An insert as in claim 1 further comprising:

lock means, attached to said cylinder, for locking the insert into the firearm whereby unauthorized removal is prevented.

8. An insert as in claim 1 further comprising:

a second stud extending from said cylinder.

9. An insert as in claim 1 wherein:

a stud is placed on a side common to said notch.

10. An insert as in claim 1 wherein:

the notch has a longitudinal length sufficient to permit movement of the hammer to strike said cylinder irrespective of the first or second end first inserted into the bolt carrier.

11. An insert as in claim 10 wherein:

a stud is placed adjacent the first end of said cylinder; and a second stud is placed adjacent the second end of said cylinder.

12. A firearm having a safety device insert comprising:

a buttstock;

a receiver attached to said buttstock;

a bolt carrier reciprocating within said receiver, said bolt carrier having a bore;

a barrel; and a cylindrical insert placed within the bore of said bolt carrier, said cylindrical insert having a first and second end and a notch positioned between the first and second end to receive a hammer, and a recess on one of the first and second end of said cylindrical insert, the recess positioned to receive a firing pin, whereby when said cylindrical insert is placed in said bolt carrier of the firearm, the hammer is prevented from impacting the firing pin.

13. A firearm as in claim 12 further comprising:

a stud attached to said cylindrical insert.

14. A firearm as in claim 13 further comprising:

a locking device placed on said cylindrical insert, said locking device preventing unauthorized removal of said cylindrical insert.

15. An insert for a firearm comprising:

a cylinder, said cylinder sized to fit within a bore of a bolt carrier, said cylinder having a first end and a second end;

a first recess placed in the first end, said first recess having a position and a size to receive a firing pin;

a notch placed in said cylinder between the first end and the second end of said cylinder, said notch having a circular portion and a straight portion, the straight portion adapted to receive a hammer, whereby when a trigger releases the hammer, the hammer is caused to strike the straight portion of the notch in said cylinder preventing the hammer from striking the firing pin.

16. An insert for a firearm as in claim 15 further comprising:

a second recess placed in the second end, said second recess having a position and a size to receive a firing pin.

17. An insert for a firearm as in claim 15 further comprising:

a stud extending from said cylinder on a side common to said notch.

18. An insert for a firearm as in claim 15 further comprising:

lock means, attached to said cylinder, for locking said cylinder within the bore of the bolt carrier preventing unauthorized removal of the insert.

19. An insert for a firearm as in claim 16 wherein:

the first end and the second end are beveled facilitating insertion of said cylinder into the bolt carrier.

20. An insert for a firearm as in claim 16 wherein:

the first end and the second end are tapered facilitating insertion of said cylinder into the bolt carrier.

* * * * *